US007167139B2

(12) United States Patent
Kim et al.

(10) Patent No.: US 7,167,139 B2
(45) Date of Patent: Jan. 23, 2007

(54) HEXAGONAL ARRAY STRUCTURE OF DIELECTRIC ROD TO SHAPE FLAT-TOPPED ELEMENT PATTERN

(75) Inventors: Yang-Su Kim, Daejon (KR); Byung-Su Kang, Daejon (KR); Bon-Jun Ku, Daejon (KR); Jong-Min Park, Daejon (KR); Do-Seob Ahn, Daejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 11/023,682

(22) Filed: Dec. 27, 2004

(65) Prior Publication Data

US 2005/0140559 A1 Jun. 30, 2005

(30) Foreign Application Priority Data

Dec. 27, 2003 (KR) ..... 10-2003-0098389

(51) Int. Cl.
*H01Q 13/00* (2006.01)

(52) U.S. Cl. ..... 343/785; 343/776

(58) Field of Classification Search ..... 343/776, 343/785

See application file for complete search history.

(56) References Cited

U.S. PATENT DOCUMENTS 5,767,807 A 6/1998 Pritchett
6,539,155 B1 * 3/2003 Broeng et al. ..... 385/125
6,597,851 B2 * 7/2003 Johnson et al. ..... 385/131
6,791,757 B2 * 9/2004 Hobbs et al. ..... 359/578
6,909,729 B2 * 6/2005 Ibanescu et al. ..... 372/6
2001/0012149 A1 * 8/2001 Lin et al. ..... 359/344

FOREIGN PATENT DOCUMENTS

JP 2002-016427 1/2002
KR 1020030071996 A 9/2003

OTHER PUBLICATIONS

Sergei P. Skobelev, "Method of Constructing Optimum Phased-Array Antennas for Limited Field of View", IEEE Antennas and Propagation Magazine, vol. 40, No. 2, Apr. 1998 (pp. 39-49).

* cited by examiner

*Primary Examiner*—Tho Phan
(74) *Attorney, Agent, or Firm*—Blakely Sokoloff Taylor & Zafman

(57) ABSTRACT

A hexagonal array structure of a dielectric rod for shaping a flat-topped element pattern (FTEP) is provided. The hexagonal structure of dielectric rods forming a flat-topped element pattern (FTEP) includes: a center element for forming a unit radiation pattern of the FTEP through an electromagnetic wave mutual coupling by receiving a polarization signal of a basic mode; a plurality of first ring elements arranged at vertexes of a regular hexagon based on the center element for forming the unit radiation pattern by electromagnetic wave mutual coupling with the center element and an electromagnetic wave; and a circular waveguide array supporting unit for supporting the center element and the plurality of first ring elements.

6 Claims, 10 Drawing Sheets

HEXAGONAL ARRAY STRUCTURE OF DIELECTRIC ROD TO SHAPE FLAT-TOPPED ELEMENT PATTERN

FIELD OF THE INVENTION

The present invention relates to a hexagonal array structure of a dielectric rod for shaping a flat-topped element pattern (FTEP); and, more particularly, to a hexagonal array structure of a dielectric rod for shaping a flat-topped element pattern (FTEP) for having a wide beam scanning range and a constant electric performance generated from a strong electromagnetic wave mutual coupling by arranging a dielectric rod at a vertex of a regular hexagon as a center dielectric rod and arranging a predetermined size of dielectric rods around the center dielectric rod.

DESCRIPTION OF RELATED ARTS

According to a Korea publication No. 10-2002-11503, entitled "Two dimensional multi layers circular radiation array structure for forming FTEP", a phase control element is a major and expensive element for developing a phased array antenna. The number of the phase control elements is determined according to a gain of an antenna array, a side lobe level and a required sector beam scan angle. The gain of the antenna array and the level of side lobe are used for determining a shape or a size of an array aperture. Also, the required sector beam scan angle is used for determining a distance of array element space.

Also, when a conventional phase control element is designed, a maximum array space of the phase control elements is determined for preventing to generate a grating lobe in a real space in order to wide beam scanning.

In contrary, in a flat-topped element pattern (FTEP) scheme, the maximum array space is determined for preventing to generate the grating lobe in the real space since it has comparative narrow beam scanning range ±5° or 25°. And, the grating lobe can be suppressed by a side lobe characteristic of the FTEP. Accordingly, the space between phase control elements becomes comparatively wider and thus the number of the phase control elements can be minimized. For example, when a phase array requiring 20° of a cone shape beam scanning is designed, the number of phase control elements can be reduced to 1/11by using the FTEP scheme. Inhere, for forming FTEP within a required beam scanning range, an amplitude array characteristic of an array aperture must be satisfied to have overlapped sub-array. Also, the amplitude characteristic of array aperture must be satisfied to $$\frac{\sin x}{x}$$

for an one-dimensional array, $$\frac{\sin x}{x}\frac{\sin y}{y}$$

for a two-dimensional array, and $$\frac{J_1(x)}{x}$$

for a three-dimensional array.

For obtaining the above-mentioned characteristic, five conventional array structures have been introduced as follows.

FIGS. 1A to 1H are diagrams showing conventional array structures having a passive multiport network. As shown in FIG. 1A, the conventional array structure having the passive multiport network includes a phase shifter 110 for providing a required phase difference between an input signal and an output signal in a beam shaping unit and a beam directioning unit in a phase array antenna system, an antenna array element 120, a multiport network 130 for forming a required amplitude and a phase distribution for the FTEP by being inserted between the phase shifter 110 and the array element 120. FIGS. 1B to 1H show embodiments of the conventional array structure having various multiport networks. However, according to the conventional array structures in FIGS. 1A to 1H, a feeding network is too complicated when it is implemented for the two-dimensional scanning. Accordingly, the conventional array structures shown in FIGS. 1A to 1H have disadvantages such as decrease of efficiency, large volume, heavy weight and high system cost.

FIG. 2A is a diagram illustrating a conventional electric plane linear array scanning structure and FIG. 2B is a diagram showing a conventional magnetic plane linear array scanning structure. A dual mode waveguide has an advantage of simplifying an antenna array design for exciting required modes by using slots of a waveguide wall since the dual mode waveguide includes a common wall. The conventional electric plane linear array scanning structure of FIG. 2A and the conventional magnetic plane linear array scanning structure of FIG. 2B include a single mode waveguide 210, 211 having a predetermined diameter $a_0$ for filtering a microwave, a matching waveguide 220, 221 having a predetermined diameter $a_r$ for providing an impedance matching between the single mode waveguide 210, 211 and a dual mode waveguide 230 and 231, and the dual mode waveguide 230 and 231 for mutual-coupling electric power by using dual slots. However, the conventional electric plane near scanning structure and the conventional magnetic plane linear scanning structure have comparative narrow bandwidth and a small beam scanning range. Also, it is limited to be implemented in a one dimensional.

FIGS. 3A to 3C are diagrams showing wrinkled waveguide array structures in accordance with a related art. As shown in FIGS. 3A to 3B, the wrinkled waveguide array structure includes an array element 310, 311 for receiving a signal from external, and a reactive load 320, 321 having a reactive impedance and having a function of a reflective termination to the array element 310, 311. In the wrinkled waveguide array structures, only few of array elements is directly connected to a phase control element and remained array elements are connected to the reactive load. Radiation from a passive radiation element connected to the reactive load is generated by reflection of the reactive load and mutual coupling between the active radiation elements directly connected to the phase control element. FIGS. 3A and 3B shows a reflection step generated by one repetition unit b. For forming the FTEP, sufficient coupling is required and additional passive scatterer may be equipped at upper of aperture. However, the wrinkled waveguide array structure requires a plurality of phase shifters since the space of the array elements is 0.7 to 0.85 λ and it is impossible designing more than 3% array antenna. Also, the wrinkled waveguide array structure has disadvantages such as large volume, heavy weight and high system cost.

FIG. 4 is a diagram showing a two dimensional multi circular radiation array structure disclosed at Korea publication No. 10-2002-11503.

As shown in FIG. 4, in the two-dimensional multi circular radiation array structure, a predetermined size (2r) of circular shape dielectric disks are arranged in a repeated unit (dx) of a regular triangle grating and stacked as N-layers within a regular space (ds) in a direction of a wave propagation direction. Therefore, a mutual electromagnetic wave coupling is naturally generated between a center feeding element and feeding elements arranged around of the center feeding element. Since the two dimensional multi circular radiation array structure is comparatively complicated to be manufactured and a successful synchronization is required for arranging disks and stocking the disks.

SUMMARY OF THE INVENTION

It is, therefore, an object of the present invention to provide a hexagonal array structure of a dielectric rod for shaping a flat-topped element pattern (FTEP) for having a wide beam scanning range and a constant electric performance generated from a strong electromagnetic wave mutual coupling by arranging a dielectric rod at a vertex of a regular hexagon as a center dielectric rod and arranging a predetermined size of dielectric rods around the center dielectric rod.

In accordance with an aspect of the present invention, there is also provided a hexagonal structure of dielectric rods forming a flat-topped element pattern (FTEP), including: a center element for forming a unit radiation pattern of the FTEP through an electromagnetic wave mutual coupling by receiving a polarization signal of a basic mode; a plurality of first ring elements arranged at vertexes of a regular hexagon based on the center element for forming the unit radiation pattern by electric wave mutual coupling with the center element and an electromagnetic wave; and a circular waveguide array supporting unit for supporting the center element and the plurality of first ring elements.

In accordance with another aspect of the present invention, there is also provided a hexagonal structure of dielectric rods forming a flat-topped element pattern (FTEP), including: a center element and a plurality of first ring elements for forming a unit radiation pattern of the FTEP through an electromagnetic wave mutual coupling by receiving a polarization signal of a basic mode; a plurality of second ring elements arranged at vertexes of a regular triangle grating having one or two first ring elements as a vertex of the regular triangle and forming a shape of a regular hexagon for forming a radiation pattern by mutual coupling with the center element and the first ring elements; and a circular waveguide array supporting unit for supporting the center element, the plurality of first ring elements and the plurality of second ring elements.

In accordance with an aspect of the present invention, there is also provided a hexagonal structure of dielectric rods forming a flat-topped element pattern (FTEP), including: 6(N−1) elements including elements from a center element to a $(N-1)^{th}$ ring for forming a unit radiation pattern of the FTEP by electromagnetic wave mutual coupling by receiving a polarization signal of a basic mode; 6N of N ring elements for forming a unit radiation pattern by being arranged within a regular space and being electromagnetic wave mutual coupled with adjacent element; and a circular waveguide array supporting unit for supporting the 6(N−1) elements and the plurality of N ring elements.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a hexagonal array structure of a dielectric rod for shaping a flat-topped element pattern (FTEP) in accordance with a preferred embodiment of the present invention will be described in more detail with reference to the accompanying drawings.

Figure 1A:
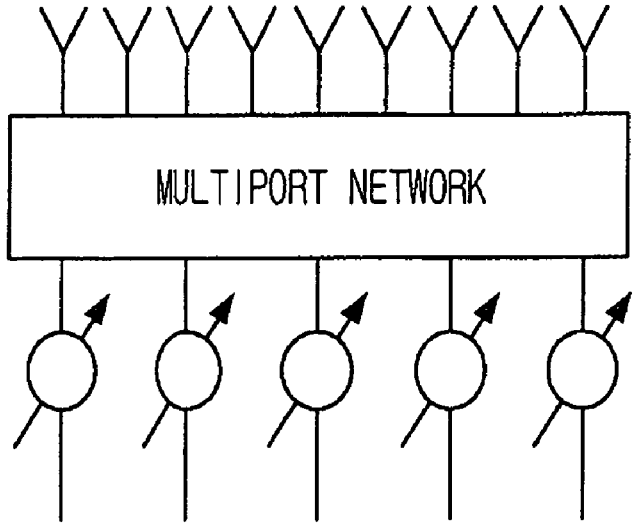
FIG. 1A (PRIOR ART)
FIGS. 1A to 1H are diagrams showing conventional array structures having a passive multiport network.
Figure 1B:
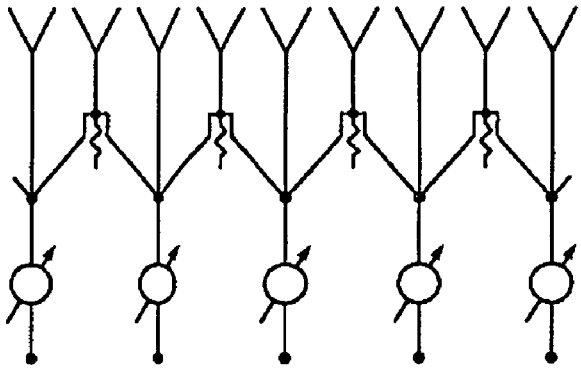
FIG. 1B (PRIOR ART)
Figure 1C:
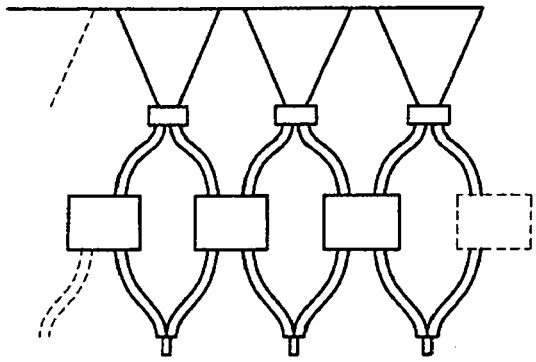
FIG. 1C (PRIOR ART)
Figure 1D:
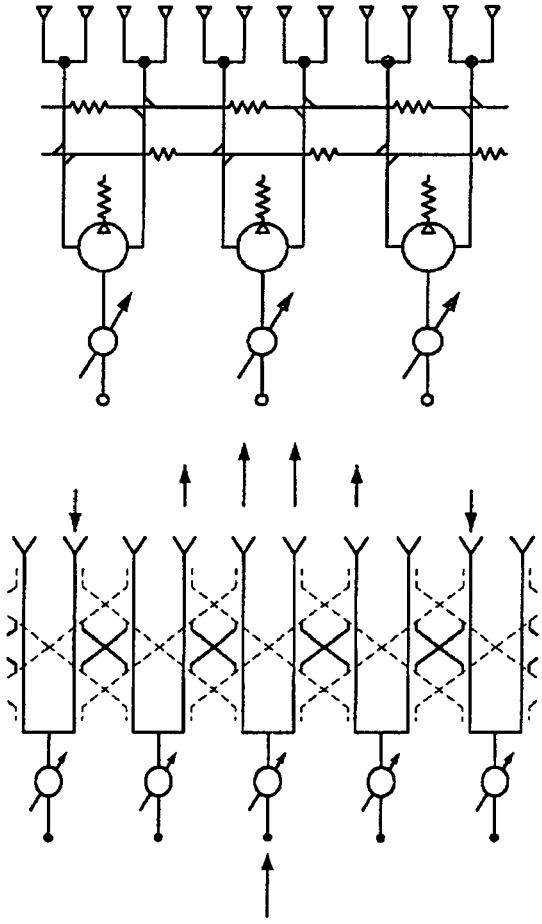
FIG. 1D (PRIOR ART)
Figure 1E:
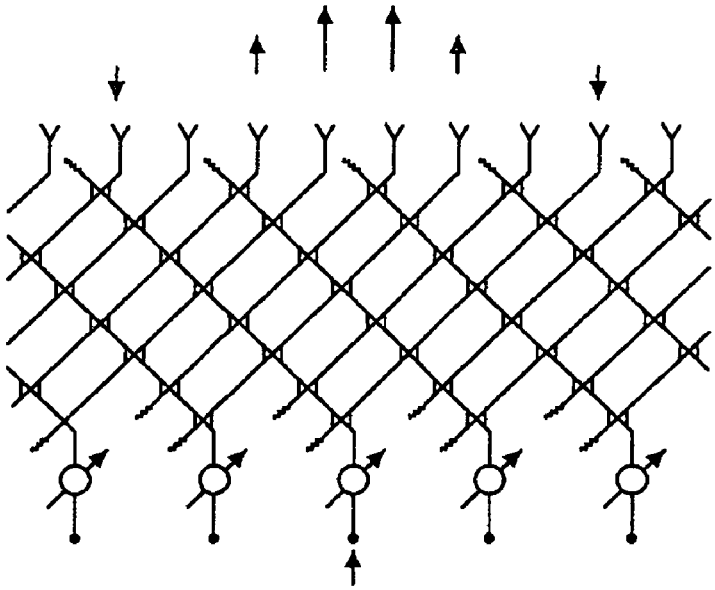
FIG. 1E (PRIOR ART)
Figure 1F:
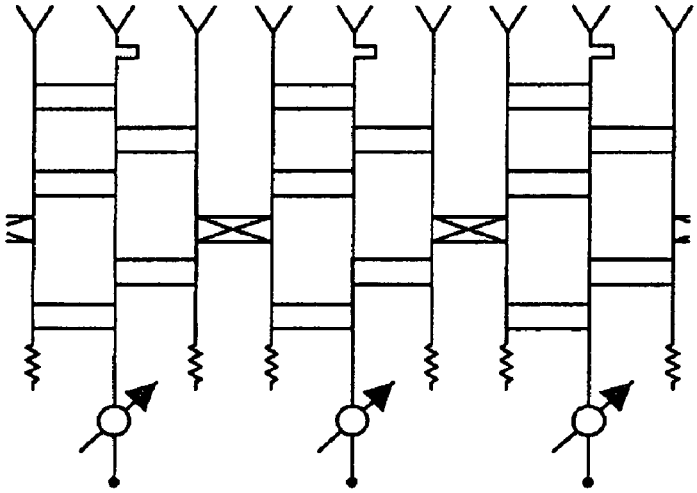
FIG. 1F (PRIOR ART)
Figure 1G:
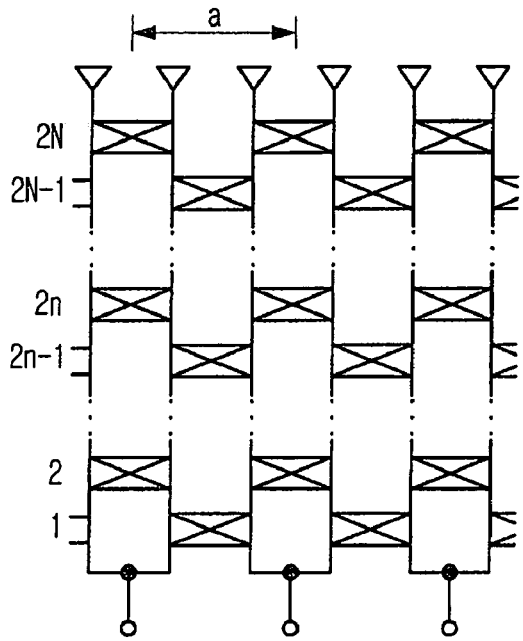
FIG. 1G (PRIOR ART)
Figure 1H:
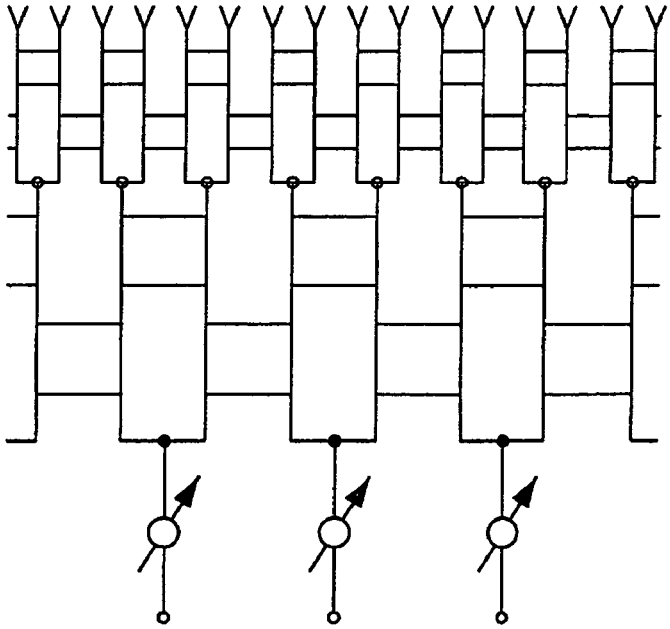
FIG. 1H (PRIOR ART)
Figure 2A:
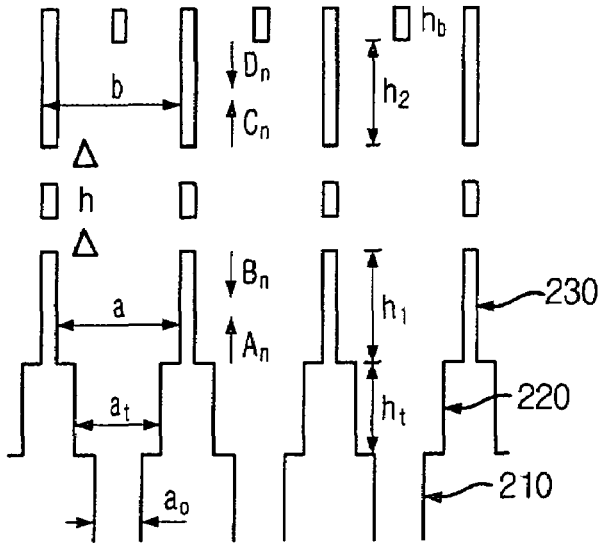
FIG. 2A (PRIOR ART)
FIG. 2A is a diagram illustrating a conventional electric plane linear array scanning structure.
Figure 2B:
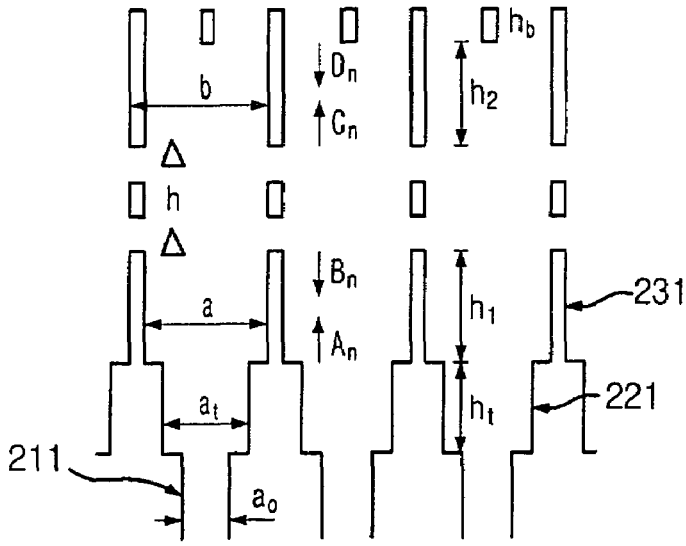
FIG. 2B (PRIOR ART)
FIG. 2B is a diagram showing a conventional magnetic plane linear array scanning structure.
Figure 3A:
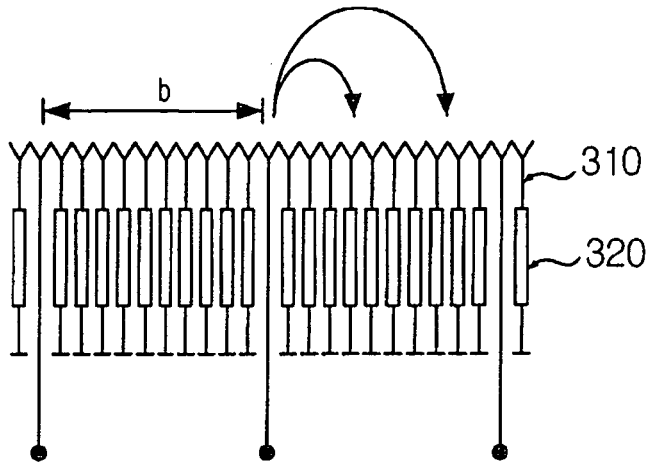
FIG. 3A (PRIOR ART)
FIGS. 3A to 3C are diagram showing wrinkled waveguide array structures in accordance with a related art.
Figure 3B:
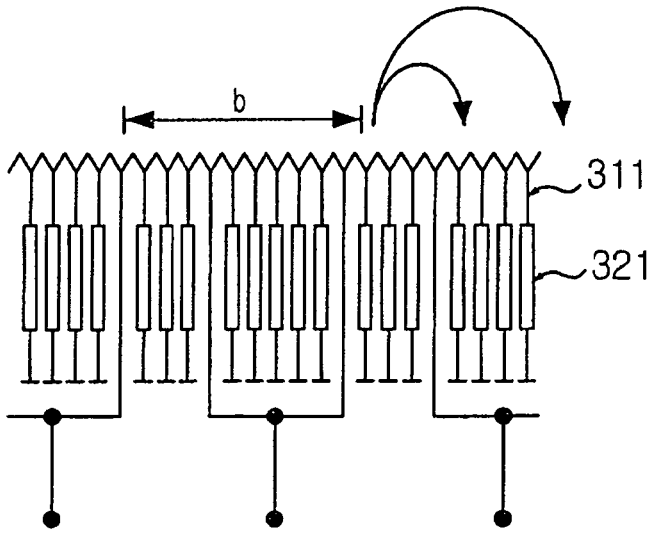
FIG. 3B (PRIOR ART)
Figure 3C:
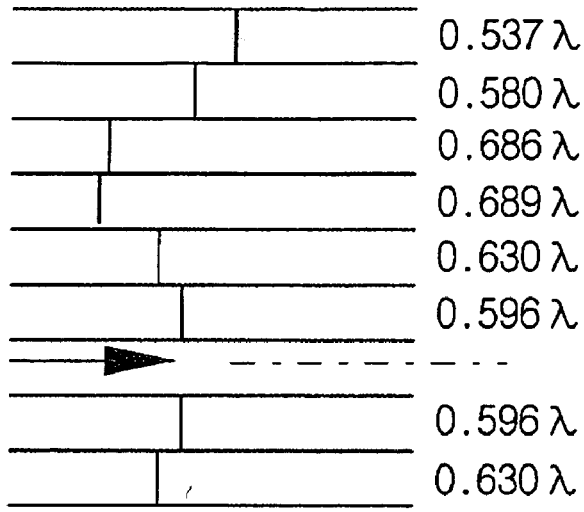
FIG. 3C (PRIOR ART)
Figure 4:
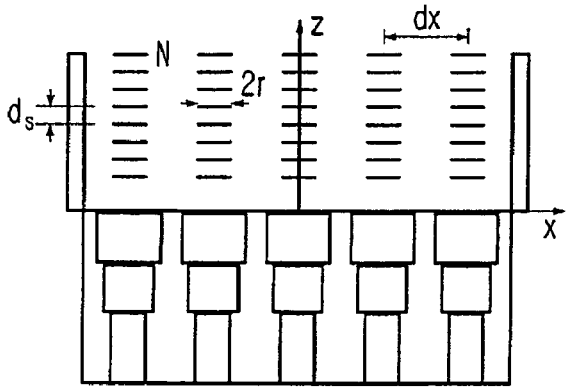
FIG. 4 (PRIOR ART)
FIG. 4 is a diagram showing a two dimensional multi circular radiation array structure disclosed at Korea publication No. 10-2002-11503.
Figure 5A:
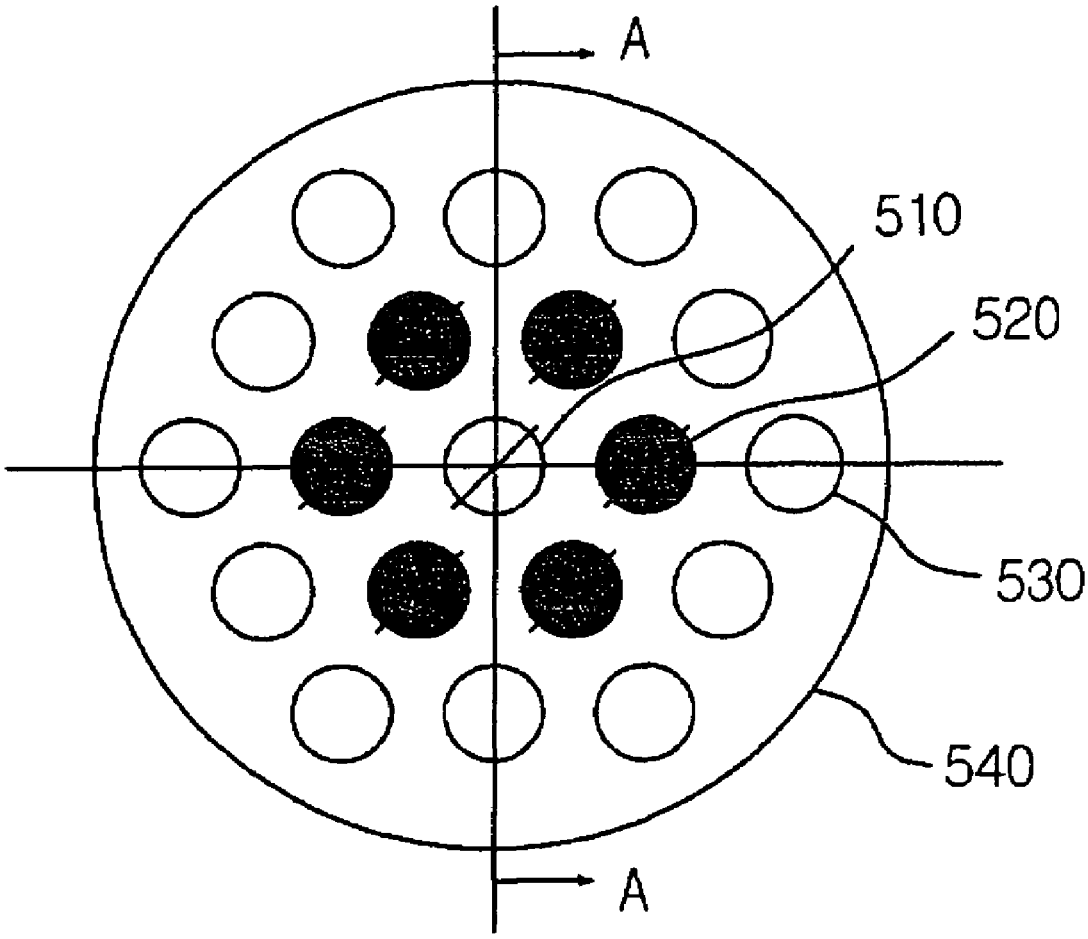
FIG. 5A is a side elevation view showing a hexagonal array structure of a dielectric rod for shaping a flat-topped element pattern (FTEP) in accordance with a preferred embodiment of the present invention.
Figure 5B:
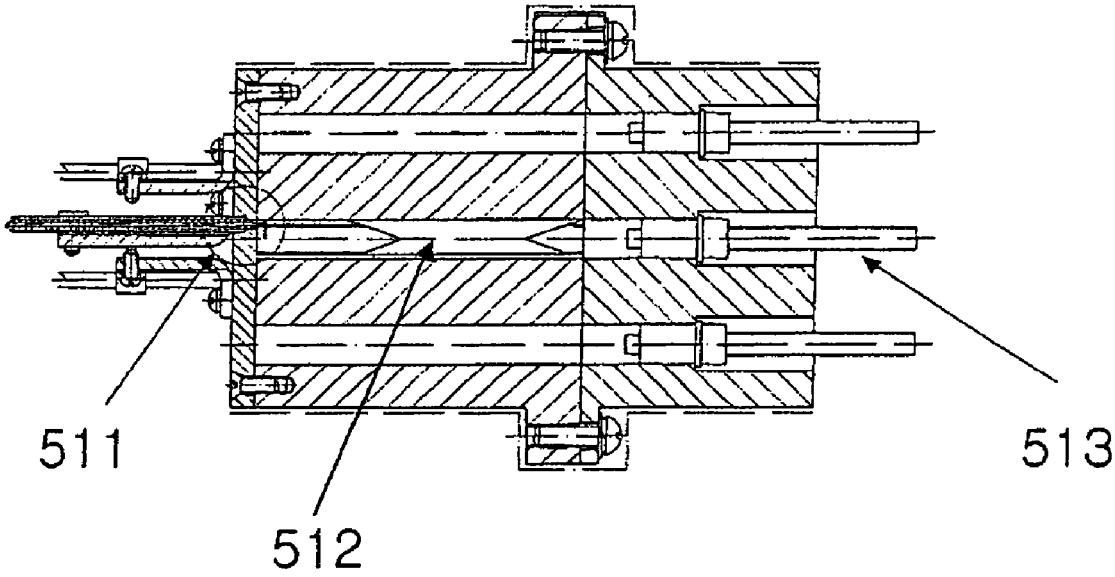
FIG. 5B is cross sectional view of a hexagonal array structure of a dielectric rod for shaping a flat-topped element pattern.
Figure 5C:
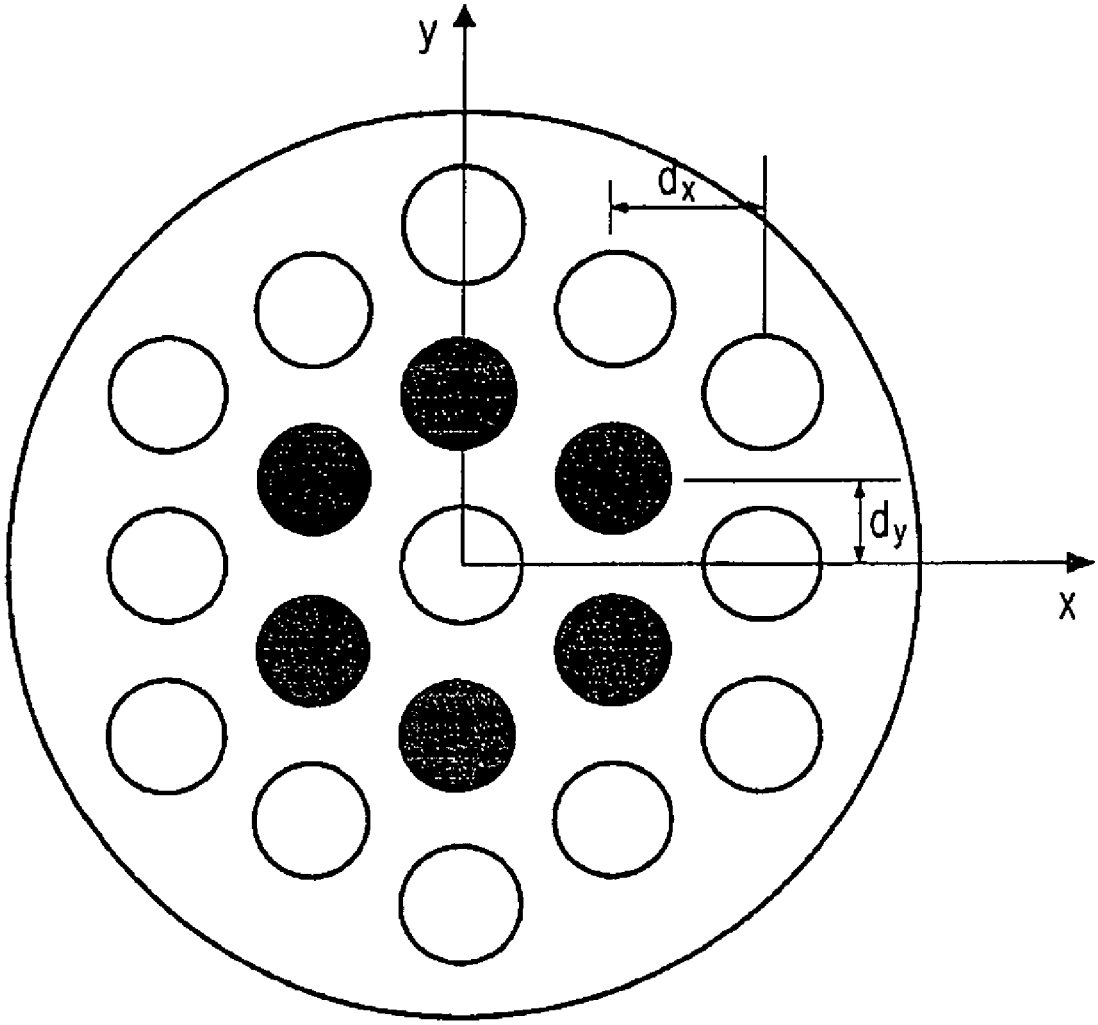
FIG. 5C is an upper side elevation view of a hexagonal array structure of a dielectric rod in accordance with a preferred embodiment of the present invention.

FIG. 5A is a side elevation view showing a hexagonal array structure of a dielectric rod for shaping a flat-topped element pattern (FTEP) in accordance with a preferred embodiment of the present invention. FIG. 5B is cross sectional view of a hexagonal array structure of a dielectric rod for shaping a flat-topped element pattern and FIG. 5C is an upper side elevation view of a hexagonal array structure of a dielectric rod in accordance with a preferred embodiment of the present invention.

The hexagonal array structure of a dielectric rod includes a center element 510, six of first ring elements 520, twelve of second ring elements 530 and a circular waveguide array supporting unit 540.

When a basic mode signal is feed through a polarizer 512 to the center element 510 and the six first rings 520, an electric distribution satisfying a requirement is formed on the twelve second elements 530 and an antenna aperture by electromagnetic wave mutual coupling of twelve second ring elements 530. Also, a FTEP radiation pattern is formed at a far-field region. The center element 510 includes an input circular coaxial cable 511, a polarizer 512 and a dielectric rod 513.

The input circular coaxial cable 511 feeds an input signal and the polarizer 512 is a thin dielectric plate located inside a circular waveguide and forms a required polarization. The dielectric rod 513 forms a traveling wave and radiates the traveling wave signal. Also, the dielectric rod 513 forms a unit radiation pattern forming the FTEP by the electromagnetic wave mutual coupling.

The center element 510 and each of the first ring elements 520 form the FTEP unit radiation pattern by mutually coupling to the second ring elements 530. The first ring elements 520 are arranged around the center element 510. The space between the first ring elements 520 is $d_x$ and $d_y$, and accordingly, locations of the first ring elements in a x y coordinate are $(d_x, d_y)$, $(d_x, -d_y)$, $(-d_x, d_y)$ $(-d_x, -d_y)$, $(0, 2d_y)$, $(0, -2d_y)$. The second ring elements are arranged at a vertex of regular triangle having one or two first ring elements as a vertex. That is, the second ring elements form a second hexagonal. Locations of the second ring elements in a x y coordinate are $(2d_x, 0)$, $(-2d_x, 0)$, $(2d_x, 2d_y)$, $(2d_x, -2d_y)$, $(d_x, 3d_y)$, $(d_x, -3d_y)$, $(0, 4d_y)$, $(0, -4d_y)$, $(0, 2d_y)$, $(0, -2d_y)$, $(-d_x, 3d_y)$, $(-d_x, -3d_y)$ as shown in FIG. 5C.

The center element 510 and the six first ring elements include the polarizer 512 for generating polarization and twelve second ring elements do not include the polarizer 512.

As mentioned above, the present invention can suppress the grating lobe and decrease the number of radiation elements by arranging a dielectric rod at a vertex of a regular hexagon as a center dielectric rod and arranging a predetermined size of dielectric rods around the center dielectric rod for shaping a flat-topped element pattern (FTEP). Therefore, the present invention can decreases a cost of antenna system, feeding loss and can be implemented to a comparative wide beam scanning.

Also, the present invention can be easily implemented for a millimeter bandwidth (more than 10 GHz) and would comparatively light by fixing constant size of dielectric rod at a waveguide.

While the present invention has been described with respect to certain preferred embodiments, it will be apparent to those skilled in the art that various changes and modifications may be made without departing from the spirits and scope of the invention as defined in the following claims.

What is claimed is:

1. A hexagonal structure of dielectric rods forming a flat-topped element pattern (FTEP), comprising:

a center element for forming a unit radiation pattern of the FTEP through an electromagnetic wave mutual coupling by receiving a polarization signal of a basic mode;

a plurality of first ring elements arranged at vertexes of a regular hexagon based on the center element for forming the unit radiation pattern by electromagnetic wave mutual coupling with the center element and an electromagnetic wave;

circular waveguide array supporting means for supporting the center element and the plurality of first ring elements; and six dielectric rod elements for forming the FTEP by the electromagnetic wave mutual coupling, wherein the six dielectric rod elements are the first ring elements.

2. The hexagonal structure of dielectric rods as recited in claim 1, further comprising:

a circular waveguide unit including a polarizer for generating polarization by feeding an input signal to the center element;

a dielectric rod for radiating a signal passed through the circular waveguide unit.

3. A hexagonal structure of dielectric rods forming a flat-topped element pattern (FTEP), comprising:

a center element and a plurality of first ring elements for forming a unit radiation pattern of the FTEP through an electromagnetic wave mutual coupling by receiving a polarization signal of a basic mode;

a plurality of second ring elements arranged at vertexes of a regular triangle grating having one or two first ring elements as a vertex of the regular triangle and forming a shape of a regular hexagon for forming a radiation pattern by mutual coupling with the center element and the first ring elements; and circular waveguide array supporting means for supporting the center element, the plurality of first ring elements and the plurality of second ring elements.

4. The hexagonal structure of dielectric rods as recited in claim 3, further comprising:

a circular waveguide unit including a polarizer for generating a polarization by feeding an input signal to the center element and six of the first ring elements;

six of dielectric rods included in a center dielectric rod and the first ring elements radiating a signal passed through the circular waveguide unit; and twelve of dielectric rod elements for forming the FTEP by the electromagnetic wave mutual coupling, wherein the twelve of dielectric rod elements are the second ring elements.

5. A hexagonal structure of dielectric rods forming a flat-topped element pattern (FTEP), comprising:

a plurality of elements from a center element to 6(N−1) elements of a $(N-1)^{th}$ ring for forming a unit radiation pattern of the FTEP by electromagnetic wave mutual coupling by receiving a polarization signal of a basic mode;

6N elements of $N^{th}$ ring for forming a unit radiation pattern by being arranged within a regular space and being electromagnetic wave mutual coupled with adjacent element; and circular waveguide array supporting means for supporting a plurality of elements from the center element to $N^{th}$ ring, wherein N is a natural number greater than one.

6. The hexagonal structure of dielectric rods as recited in claim 5, further comprising:

a circular waveguide unit including a polarizer for generating a polarization by feeding an input signal to elements from the center elements to the 6(N−1) elements of the $(N-1)^{th}$ ring;

6(N−1) of dielectric rods included in the (N−1) rings radiating a signal passed through the circular waveguide unit and a center dielectric rod for radiating a signal passed through the circular waveguide unit; and 6N of dielectric rod elements for forming the FTEP by the electromagnetic wave mutual coupling, wherein the 6N of dielectric rod elements are the elements of the $N^{th}$ ring.

* * * * *